US006098367A

United States Patent [19]

Fridman et al.

[11] Patent Number: 6,098,367

[45] Date of Patent: Aug. 8, 2000

[54] CONSTRUCTIVE SYSTEM APPLIED FOR BUILDINGS

[76] Inventors: Hernando Fridman; Gustavo Daniel Fridman; Horacio Martin Fridman, all of Scalabrini Ortiz 3183, 4°A, (1425) Buenos Aires, Argentina

[21] Appl. No.: 08/892,456

[22] Filed: Jul. 14, 1997

[30] Foreign Application Priority Data

Jun. 27, 1996 [AR] Argentina ..... P96 01 03350

[51] Int. Cl.[7] ..... E04C 2/38

[52] U.S. Cl. ..... 52/656.1; 52/645; 52/780; 52/763; 52/779

[58] Field of Search ..... 52/645, 241, 780, 52/781, 307, 763, 779; 5/99.1

[56] References Cited

U.S. PATENT DOCUMENTS

| | | | |
|---|---|---|---|
| 1,924,986 | 8/1933 | Frazier | 52/632 |
| 2,363,164 | 11/1944 | Waller | 52/282.5 |
| 2,744,590 | 5/1956 | Butts | 52/645 |
| 3,111,202 | 11/1963 | Costello | 52/645 |
| 3,204,382 | 9/1965 | McGurn | 52/349 |
| 3,224,048 | 12/1965 | Sullivan | 20/71 |
| 4,033,084 | 7/1977 | Shiflet | 52/573 |
| 4,058,951 | 11/1977 | Dean | 52/656 |
| 4,546,591 | 10/1985 | Beltz | 52/645 |
| 4,612,848 | 9/1986 | Pollack | 98/50 |
| 5,203,132 | 4/1993 | Smolik | 52/241 |
| 5,412,919 | 5/1995 | Pellock et al. | 52/656.1 |
| 5,572,847 | 11/1996 | Elmore et al. | 52/766 |
| 5,606,840 | 3/1997 | Hase | 52/780 |
| 5,638,644 | 6/1997 | Bastian | 52/36.6 |
| 5,724,779 | 3/1998 | Chang | 52/239 |
| 5,735,100 | 4/1998 | Campbell | 52/645 |
| 5,822,940 | 9/1998 | Carlin et al. | 52/479 |

*Primary Examiner*—Christopher T. Kent
*Assistant Examiner*—Jennifer I. Thissell

[57] ABSTRACT

A constructive system applied to buildings in general, to form walls, by means of modular foldable frames attached, who allow to place from the upper part blocks or plates and support it.

The blocks have horizontal or vertical holes, to pass brazing rods, linkes with the frames.

The blocks when overlapped form channels, to pass rods linkes with the frame

The frames when are formed by two vertical jambs and two horizontal articuladed piedes. When joined together with other adjacent, form filling channels, to fill with resistant materials, and other channels to fill with materials to seal joints of blocks or plates.

The frames with the resistant channels, rods, blocks or plates, resist better strong winds and seismic movements.

12 Claims, 18 Drawing Sheets

CONSTRUCTIVE SYSTEM APPLIED FOR BUILDINGS

BACKGROUND OF THE INVENTION

The present invention refers to a construction system for buildings in general and housing in particular.

For some years now, buildings have been constructed with walls of different thicknesses for support and enclosing, of 30 cm and 15 cm, respectively, with solid bricks of about 14 cm×28 cm×5 cm, as an average measurement, after making the foundations with the same bricks or piles, pilettes and foundation plates according to the type of soil and load magnitudes, etc..

Once the soil level is reached, a waterproof layer is layed and levelled, vertical rules or strings to define the vertical plane of a wall to be built are placed as well as strings to define the horizontal rows of bricks.

In this way, one can at least get the wall to be straight and uniform, since brick sizes since they lack standardization and generally vary. The walls are then coated, thereby levelling the uneven thickness thereof, after placing a vertical waterproof coating or else the bricks are left visible.

In order to carry out this job, the bricklayers wet the bricks to enhance adhesiveness of the cement or mixture used to join them. The bricks are therefore aligned and levelled by knocking them gently, removing the excess cement and continuing with the next row, offsetting the bricks so that they interlock or else placing some crosswise according to the desired width and aspect of the wall.

This conventional process is slow and work needs to be stopped for the day once a certain height is reached to allow the cement to set partially and convey minimmum strength to the wall to avoid it being flipped over by the wind and other factors.

The same bricks may be used for the enclosure or inside walls although hollow or machine ceramic bricks of different thicknesses are preferred when there is a concrete structure. These bricks have uniform measures, since they are manufactured with extruder machines. They therefore use up less cement and are also lighter.

In general, these walls are coated with sand-based mixtures, lime, etc. or plaster. The process is also slow, requiring the use of vertical guides and strings.

To build supporting and non-supporting walls, hollow concrete blocks are built, of e.g. 20 cm×20 cm×40 cm, for the outer or supporting walls and 10 cm×20 cm×40 cm for the inner walls and special pieces are made for corners, door and window frames, lintels, etc.. The blocks are heavy and, preferebly, grey coloured. The wall should be of a certain length, have expansion control joints to avoid cracking and a proper foundation to avoid settling and consequent fissures, since they resist compression well but not traction. They are placed with cement.

It is also necessary in this case to use strings or vertical guides when placing the blocks for the wall to rise in a vertical plane and strings for the blocks to be at the same level. They are generally left uncoated.

This process is also slow.

Other techniques exist for building walls, bound within the so-called heavy prefabrication, based on large-sized, heavy panels or plates of prestressed or reinforced concrete, which require the use of cranes for transfering and placing. These elements are generally built off-site in plants using machines for filling, vibrating, moving moulds and curing, etc., requiring considerable investments.

Other systems exist based on the use of the so-called plaster table, which comprises a plaster panel coated on the outside with 7- or 9-mm thick paper. Since the plaster is a hygroscopic material, they may not be used for outside walls on the side exposed to rain.

SUMMARY OF THE INVENTION

The present invention affords the following advantages:

Faster construction system.

No mortar or cement required for placing each brick or block.

No levelling of these elements is needed, nor removal of the surplus cement.

The joints need no finishing.

Vertical guides and strings are not necessary.

The blocks may have less thickness and be lighter, thereby reducing the cost thereof.

Construction of inside or outside walls and the resistent structure may be carried out simultaneously with other materials affording greater resistance to traction stresses relative to bricks or blocks.

Combine the outer wall materials, the outer surfaces of which are resistant to rain, with the plaster plaque facing the inside.

Better wall resistance to strong winds without substantially increasing the cost thereof.

Less cement required.

Smaller and lighter resistant structure, considering transportation thereof from manufacturing site to building site.

No interruption of wall building at different levels to allow partial setting of the cement.

A more rational structure, with a better load distribution and taking greater advantage of materials, thereby lowering costs of e.g. beams.

The present invention uses blocks or plates having special features, including one or more generally vertical or horizontal through orifices adapted to form ducts when mounted with no offset for pouring matter sealing the joints or unions of an entire assembly placed in a modular frame. These ducts may also be used for passing horizontal or vertical bracing rods which, togeteher with the poured concrete, form reinforcing ribs linked to the modular frame.

The blocks and plates are placed in frames adapted to form channel ducts when abutted against one another and are provided with orifices for passing horizontal or vertical rods which link the vertical rods and the ribs to the modular frames.

The modular frames are foldable to enable transport thereof. They comprise two vertical members or profiled jambs, two horizontal members pivoting about the jambs to maintain a constant distance and link the two vertical members having different sections, to facilitate assembly of the structure formed by various modular frames, or combinations of multiples thereof, and other members that join various jambs to one another.

The jambs have fins for holding the blocks or plates until the concrete is poured into one or more modular frames and reinforcing horizontal or vertical ribs are formed.

The ducts formed by two adjacent modular frames through the jambs may further be used as permanent lining or moulds for filling with concrete, according to the resistent calculus, increasing rigidity and resistence to compression stress by acting as columns according to the section thereof, thereby providing a better load distribution and less costly beams since the calculated gap is shorter. This circumstance provides taking better advantage of the jamb material, when metallic material is used, by combining the resistence of, e.g., a thin, low-cost metal plate which provides better traction resistence with the concrete poured therein which provides better compression resistence, instead of using a thicker and costlier plate without a concrete filler, thereby providing a more economical structure and more adaptability to different load states, requiring more jambs to be filled, or alternating jambs or just the middle one, according to calculus, for example in windy or seismic zones.

A truss formed by bars may be placed in the pouring ducts. On one hand, the modular frame helps to slide the blocks or plates in place in the fins of the jambs, without having to lead-weight or align them in view of that the frame acts as a guiding and supporting means, and without putting cement, until the bracing bars are passed and the entire assembly is in place in the modular frame, whereafter material for sealing joints and unions may be poured in which, furthermore, provides resistant ribs.

On the other hand, the jambs form two kinds of ducts according to the features of the blocks or plates, i.e. one horizontal duct and one or more vertical ducts.

If the ducts are horizontal, the frame is provided with a frontal vertical pouring duct, por passing the joint sealing material, with orifices through which the bracing bars pass, as well as the material for filling the horizontal pouring ducts of the blocks, forming the ribs and sealing unions and joints. The jambs form a back duct behind the former one for filling with concrete.

If the pouring ducts of the blocks or plates are vertical, on placing one on top of the other they form a pouring duct for sealing joints through which the bracing bar is passed. Once it is braced to another, lower beam at one end and an upper beam at the other end, the joint sealing material is poured to form a vertical strengthening rib connected to the modular frame.

By means of horizontal members which are placed between the blocks, for example, within the middle third, with an orifice for passage of the bracing bar, linked to horizontal members connecting the frame which makes up a wall, the buckling height of the vertical strengthening rib is limited.

The system is completed by a horizontal member for forming a lower bracing beam which acts as a mould for filling with concrete, to join the lower ends of the modular frame jambs, and horizontal members for forming an upper beam which may be filled with concrete or, furthermore, reinforced by a truss, according to the design applied load.

The system of the invention uses a modular frame, about 50, 70 or 90 cm wide, formed by two vertical members or jambs, preferably of shaped metal sheet, connected by two transversal mebers hinged at the ends thereof, to enable the frame to be folded for transport, occupying a minimum volume since their two sides practically abut against one another.

The shape of each jamb is somewhat different according to whether the pouring ducts are horizontal or vertical and the shape of the edges of the blocks or plates.

The jambs have orifices for passage of transversal horizontal members which join adjacent frames, orifices for the passage of piping for water, gas and drains and for the passage of bracing bars when they are horizontal. They also have orifices for connecting jambs belonging to different modular frames.

A continuous upper member connects the upper ends of all the jambs within the width of the wall to be built but leaving room for passing the blocks or plates through the rims of the jambs of each modular frame, from the top thereof so as to be able, once the operation is terminated, to place another symmetrically to form a beam on top of all the frames. This beam has holes for passing vertical bracing bars for pouring reinforcing material and for filling the pouring ducts with sealing material, with a separation so as to avoid mixing respective materials in the first filling operation.

The interior parameters of the frames of the outer walls may be cladded on both sides with blocks or panels of plaster or other materials. The inner walls may also be cladded likewise.

The system of the invention does not use cement for connecting each block or panel to the next as they are placed one on top of the other, as mentioned beforehand.

The formation of horizontal spaces between overlying blocks or panels obstructs the poured mixture from getting out, such that the external appearance of the joints in the ouside walls is given by the bonding, with apparent joints.

The system foresees the use of frames having the same width as the module, or a multiple thereof, for placing windows or doors or both, suiting it to a specific architectural project. In this way, for instance, a modular frame of, e.g., 50 cm may be combined with another of 1.0 or 1.5 meters having a window, followed by two modular frames and one 1.0 meter wide frame having a door with the frame thereof matching this dimension.

For special cases, the system foresees frames for filling additional columns.

Plastics bushings are used for sealing the orifices in the jambs for passage of piping to avoid the mixture from seeping out when poured into the resistent duct.

The lower member joining the different modular frame, shaped as a U with fins of different sizes, has orifices for connecting it by means of anchor bolts to the chained beams or foundations and, in turn, to act as a mould for filling in the concrete and necessary bars, in order to join all the bottom ends of the jambs which are prepared with orifices for the passage of said bar when necessary and also for anchoring the bottom end of the vertical bracing bar when the pouring ducts are vertical.

All the members, jambs, horizontal linking members, lower and upper members, diagonal, etc. are prepared with orifices for use in connecting them.

The system has jambs suitable for making the corner and the corresponding pouring ducts and bracing members for the transversal walls.

The present invention may be applied to antiseismic constructions.

The ceramic brick and hollow concrete blocks withstand compression stresses well but not traction stresses which, if big enough, may crack or break the members. Earth tremors produce horizontal and vertical waves which produce displacement according to epicentre location, type of terrain, degree or intensity of the tremor, duration thereof, etc; generating traction stresses affecting walls which may crack or collapse.

This may be reduced with antiseismic buildings provided with horizontal and vertical chained beams which reduce the surface of the bracing masonry part or with concrete structures which comply with special regulations for each seismic region.

However, because of the cost thereof, it is impossible to lock all bricks or blocks.

The present invention enables all blocks or panels to be partly or fully locked, to form an appropriate resistant structure without substantially increasing the cost thereof by using bracing bars and pouring ducts capable of supporting traction stresses.

The modular framewoork materials may be galvanized or rust-protected steel plates of different thicknesses according to the necessary resistence or other materials such as PVC, etc., or a combination of these materials.

The blocks may be made of concrete, cellular concrete, plaster, concrete lightened with different materials such as, for example, expanded lava, expanded mica, expanded polysterene or the likes, solid or hollow ceramic materials, glass fibre or others providing an external resistant layer filled in by or adhered to another having lower resistance but greater thermal and acoustic isolation.

The plates may be made of concrete, reinforced concrete, prestressed concrete, lightened concrete, cellular concrete, plaster, glass fibre, etc. and combined materials to provide better thermal insulation.

The modular frames leave a space between the coated surface facing outwards and tje surface facing inwards which, according to the region, may be filled in with thermal insulation and enhancing materials, for example, glass fibre, mineral fibre, polyurethane, cellular concrete, etc.

The blocks or plates may be shaped as rectangular prisms, having narrow grooved surfaces, two of which are vertical, for insertion in the modular frame jamb flanges, and the other two horizontal to facilitate placing narrow metal or plastic strips to, for example, seal the horizontal joints between blocks and pouring ducts and horizontal or vertical braces or both, whichever the case may be. These grooves further help to spread the pouring materials between the concrete surfaces of the blocks or plates and the jambs of the modular frame.

The horizontal union surfaces of the block may have a male/female conformation, leaving space for the pouring material, a horizontal groove on the upper edge of the block or plate to asist in moving a horizontal bracing-bar and a space between the blocks to generate a horizontal reinforcement rib when carrying out the pouring, through their union mioxture pouring ducts.

Furthrmore, the vertical edges of the block or plate may have a male/female conformation corresponding to the fin formed in the jamb.

In all cases the block or plates may be lightened by additional perforations.

The jambs of the modular frameworek have orifices for linking them to the jambs of adjacent modular frame. The height of the jambs may be extended by means of internal linkage members since the end of the frame jambs are free.

The material for sealing the joints, according to the block or plate material having waterproofing or plastiifying aggregates, may be poured individually from the top of each modular frame or using a machine and tubing feeding one or more ducts.

The pouring of concrete in the respective ducts may done in the same way. If the top beam is also to be filled with concrete, this may be done at the same time.

BRIEF DESCRIPTION OF THE DRAWINGS

For better understanding attached are drawings with details.

DETAILED DESCRIPTION OF THE INVENTION

Figure 1:
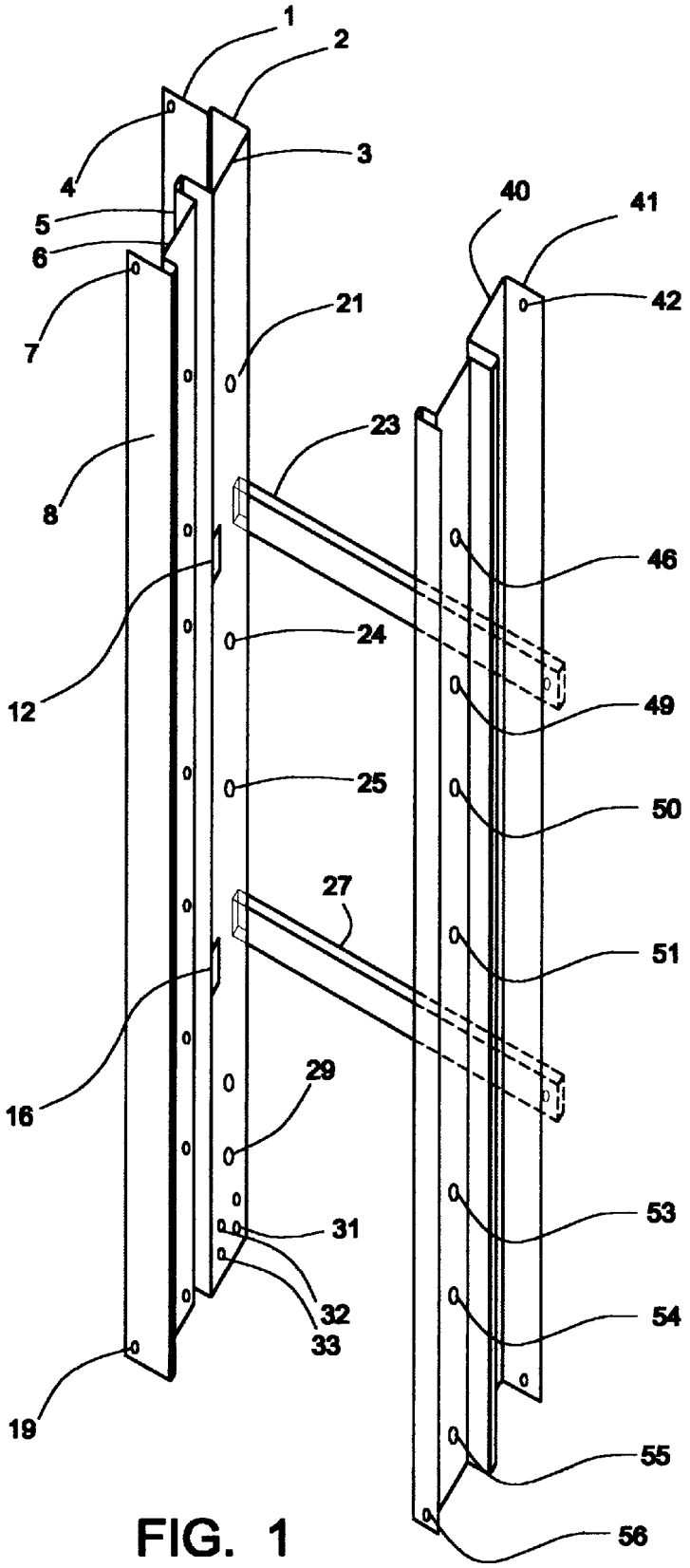
FIG. 1 is a perspective view of a modular frame.

FIG. 1 is a perspective of the modular frame, formed by two vertical pieces of jambs 1 and 40, and two transversals pieces 23 and 27 that limited the wide, and serves to hold the interior covering.

Figure 2:
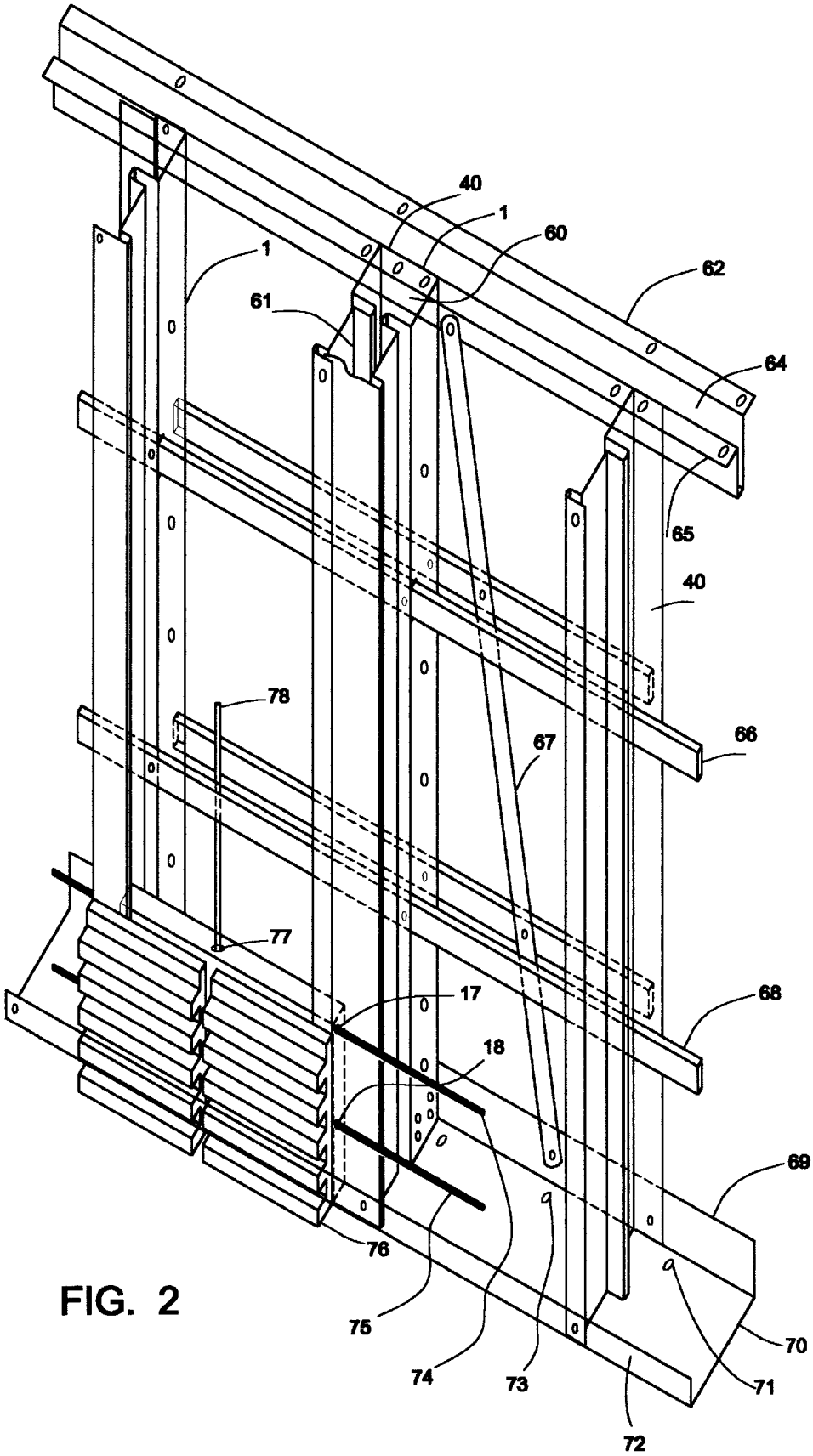
FIG. 2 is a perspective view of two adjacent modular frames attached.
Figure 29:
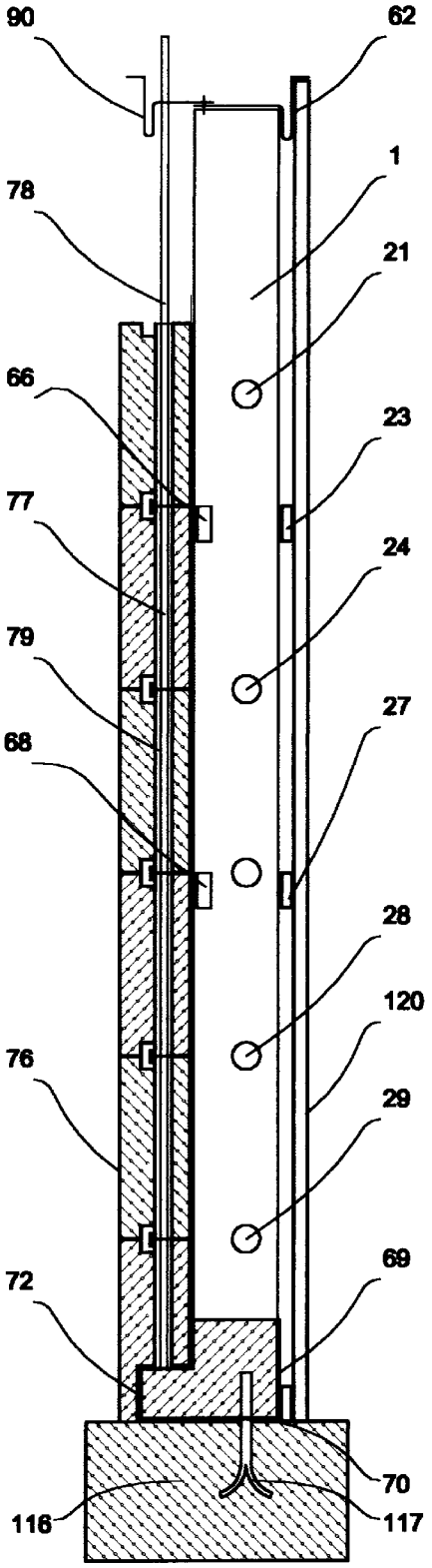
FIG. 29 is a section by a vertical perpendicular plane, to a wall with proposed system, of the type with a vertical filling channel.

In that FIG. 1 is the left jamb, 2 a little wing of the back face, 3 the face perpendicular to the last, 4 a hole to pass a union element with the linking superior piece 62 showed in FIG. 2, 5 a folded part perpendicular to face 3, to limit a back filling channel, 6 one of sides of the anterior filling channel, 8 the frontal face forming a little wing to hold the blocks, 7 a hole to pass a union element of frontal little wings of two jambs of different frames to a superior beam showed in FIG. 2 and 29. 12 and 16 are holes to pass transversal union pieces of several frames 66 and 6 showed in FIG. 2, 19 a hole to place a union element in the inferior part of jamb with a piece 72 linked with the foundation, showed in FIG. 2.

21, 24 25 and 29 are holes of jambs for pass pipes of installations, with bush box, to avoid the filling resistance material, go out.

31, 32, 33 are holes prepared in the inferior part of jambs, to pass horizontal rods correspondent to an horizontal braze beam.

40 is the right jamb of modular frame, being 41 the back side, 42 a hole for a union element, with a superior linking piece 62, showed in FIG. 2

46, 49, 50, 51, 53, 54, 55 are holes to pass horizontal braze rods

56 is a hole to joint inferior parts of jambs 40 with piece 72, linked with foundation.

FIG. 2 shows two adjacent modular frames attached, forming with jambs a back filling channel 60 for resistant mortar, and one anterior 61 to fill a material for seal joints.

Left modular frame it is formed by the same pieces 1 and 40 of FIG. 1, and the same happens with right adjacent modular frame.

It is possible to see two union continues pieces 64 and 65 of the length of the wall, one inferior union piece 69 who links inferior parts of jambs and other perpendicular 70, which has holes 71, 73 for pass braze bolts connected with foundation.

This piece 70 serves as a mold for an inferior braze beam.

Also if filling channels are vertical as 77 which a braze rod 78 who riches superior part of wall, such inferior beam serves to anchor inferior parts of all vertical rods, as it is possible to see also in FIG. 29.

FIG. 2, also shows diagonal 67 in one direction, to avoid the movement of modular frames, to one side until all parts are put together, and channels are filled, and also to absorb perpendicular forces of transversal walls, Can have other diagonals in opposite direction according calculus, and particular conditions, of the place where shall the building be constructed, submitted or not to strong winds or protected by other higher buildings, etc.

In this figure, it can be seen that a top V-shaped continuous member 62 joins the top ends of the modular frames in manner enabling passage of the blocks or plates 76. Therafter, the continuous member is complemented by a symmetrical member 90 (FIG. 29) to form a mould wherein reinforced concrete may be poured for providing a beam, according to load bearing requirements, such as support for a roof or upper floor.

In FIG. 2 it is possible to see blocks or plates 76 with filling channels as section of FIG. 29 and horizontal braze rods 74 and 75, passes by holes of joints 17,18, etc.

In embodiments employing horizontal ducts in the blocks or plates, once the latter have reached the top part of the wall, material is poured down the ducts to suitably join and seal the blocks or plates.

If it is necessary to resist charges of a floor structure, or reinforce walls against wind action, or for a seismic area, can be filled the back filling channel with concrete, as mentioned before.

Figure 3:
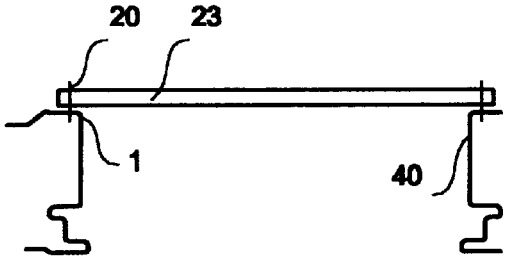
FIG. 3 is a plane view of modular frame of FIG. 1.

FIG. 3 is a plane view of a modular frame of FIG. 1, where it is possible to se jambs 1 and 40, transversal union pieces 23, articulated in 20, with union elements.

Figure 4:
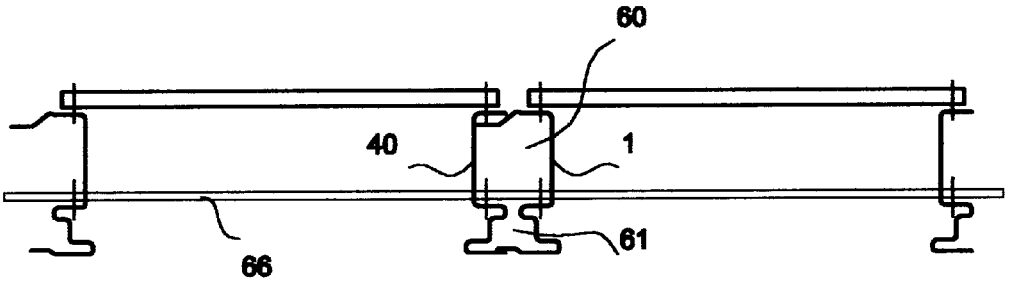
FIG. 4 is a plane view of two adjacent modular frames.

FIG. 4 is a plane view of two adjacent modular frames, similar as to FIG. 3, who shows jambs 1 and 40, when fastened with screws or similar, form the back filling channel 60, and the anterior filling channel 61.

Also shows continue transversal union piece 66.

Figure 5:
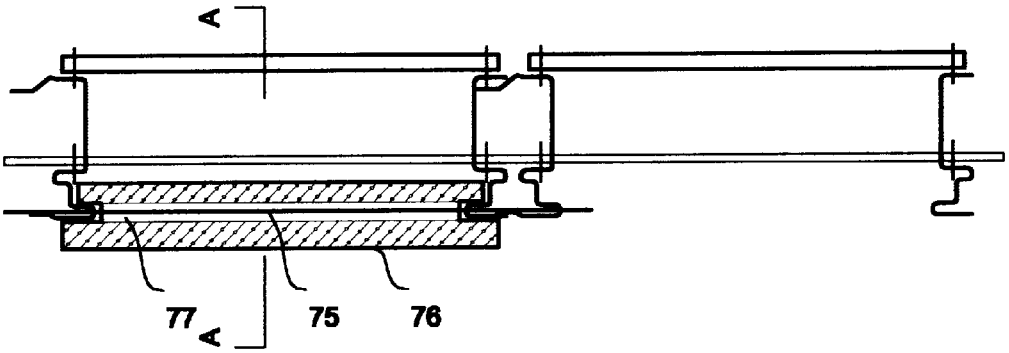
FIG. 5 is a sectional view, showing two modular frames and one block with the filling channel and the horizontal brace rod.

FIG. 5 is a section of two adjacent modular frames similar as FIG. 3, with a block or panel 76, with a horizontal filling channel 77, the braze bar 75 who pass by appropriate holes of jambs.

Figure 6:
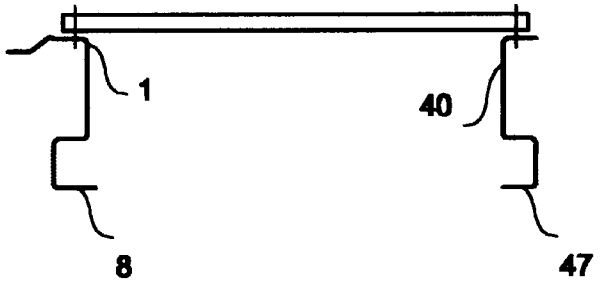
FIG. 6 is a plane view of a modular frame, for the case of blocks with two vertical grooved sides, and one vertical filling channel within them.

FIG. 6 is similar as FIG. 3, and shows jambs 1 and 40 of modular frame, with the adequate shape for grooved blocks, supported by the little wings 47 and 8.

Figure 7:
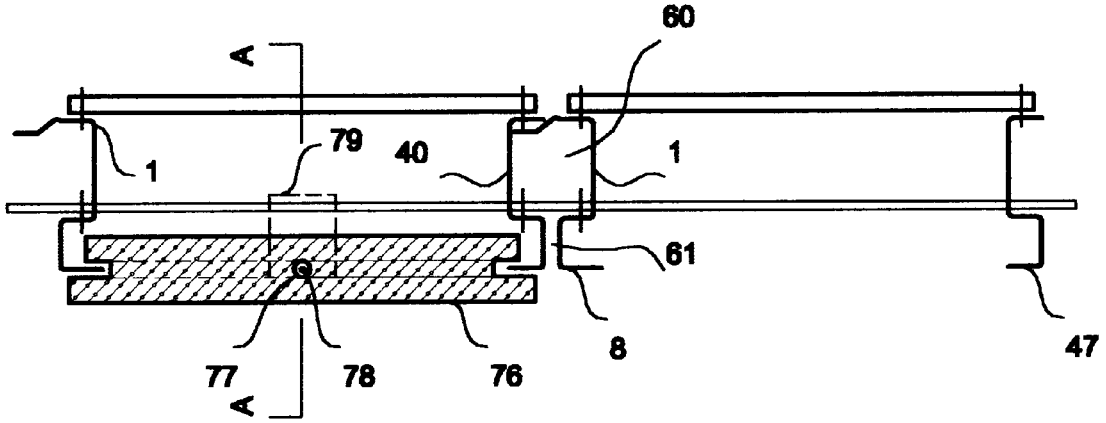
FIG. 7 is a sectional view of two adjacent frames attached as FIG. 6, showing a block with his vertical sides grooved, the filling channel with the vertical brace rod and the horizontal distribution groove.

FIG. 7 is similar as FIG. 5, where appeared two adjacent modular frames, with its jambs 1 and 40, filling channel 60, the vertical feeling channel 77 with the braze bar 78, and a horizontal piece 79, in form of a inverted U.

It shows block 76 with its grooved borders, takes contact with little wing shaped 8 and 47 of jambs 1 and 40.

Figure 8:
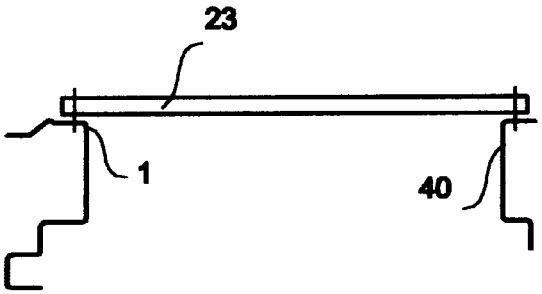
FIG. 8 is a plane view of a modular frame, with his little wings shaped jambs for a block with a vertical braze rod and the vertical sides type male and female.

FIG. 8 shows a similar view as FIG. 3 with jambs 1 and 40, of a modular frame prepared for a block or plate, with its sides, type male and female and vertical filling channel, being 23 the union piece.

Figure 9:
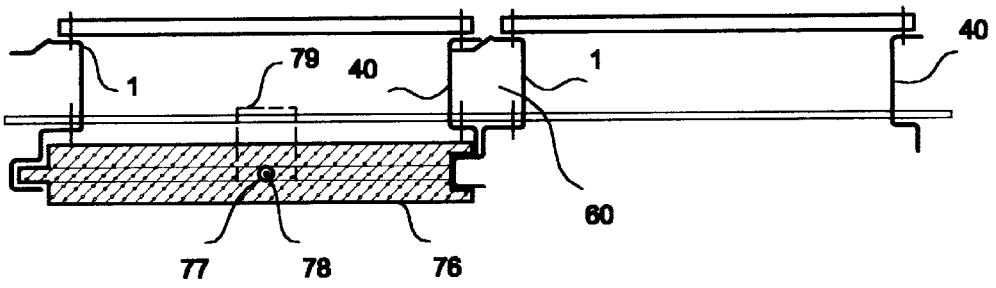
FIG. 9 is a section view of two adjacent modular frames attached, similar as of FIG. 8, with a block, who has a vertical filling channel.

FIG. 9 shows two modular frames similar as of FIG. 8, with its jambs 1 and 40, and the back filling channel 60, the block 76 with its sides type male and female and the vertical filling channel 77, the braze bar 78 and the anchor piece 79.

Figure 10:
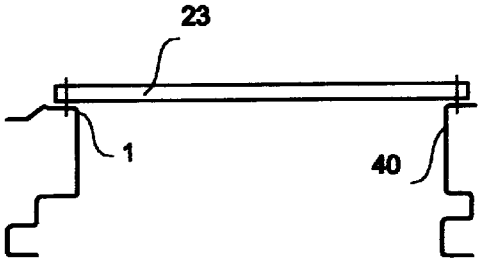
FIG. 10 is a plane view of a modular frame with little wings shaped jambs, for a block with vertical sides, type male and female

FIG. 10 is a similar view as FIG. 3 of a modular frame, with its jambs 1 and 40, prepared for blocks or plates with its sides type male and female and the union piece 23.

Figure 11:
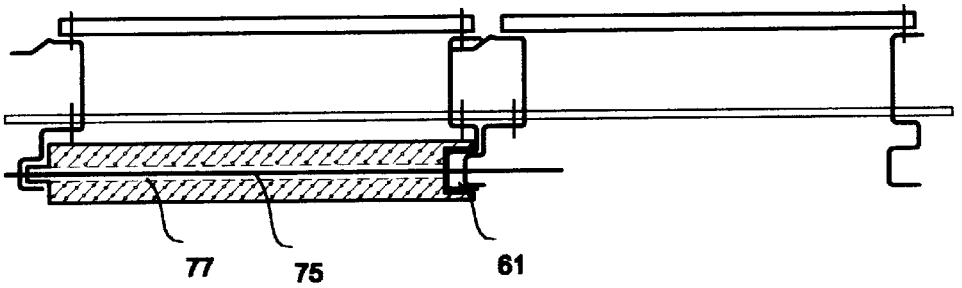
FIG. 11 is a section of two adjacent modular frames attached, similar as of FIG. 10, with a block that has vertical sides type male and female, and a horizontal brace rod.

FIG. 11 shows two modular frames similar as of FIG. 10, prepared for a block with its sides type male and female, with the horizontal channel 77, the braze rod 75 and filling channel 61.

Figure 12:
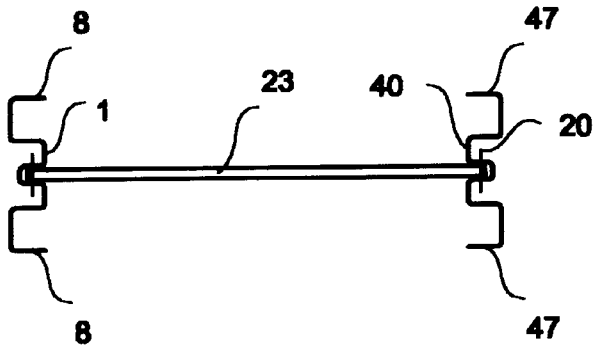
FIG. 12A is a plane modular frame to hold blocks in its two sides.
FIG. 12B is a section of two adjacent modular frames similar as of FIG. 12A with blocks in both sides, that has vertical filling channels.
Figure 12:
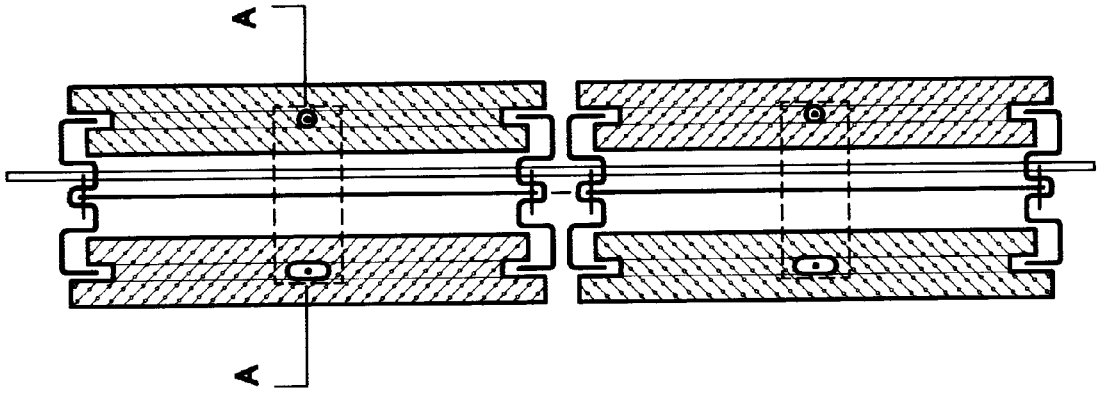

FIG. 12A is a section of a modular frame, according FIG. 6 for grooved blocks, placed on the two sides of that frame.

The same can be applied with FIGS. 3; 8 and 10 considering symmetric modulate frames taking as symmetric axis union pieces 23.

FIG. 12B is a section showing two modular frames similar as of FIG. 12A with blocks or plates in both sides.

Figure 13:
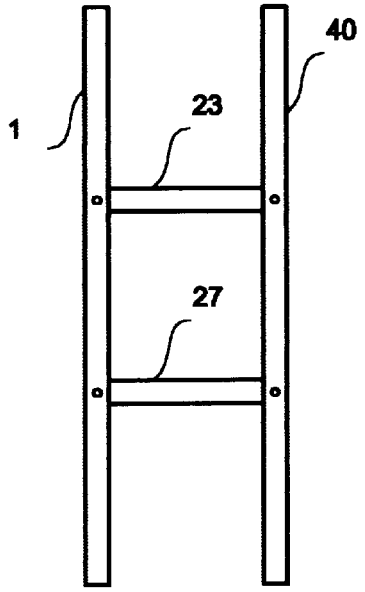
FIG. 13 is a front view of a modular frame.

FIG. 13 is a front view of modular frames of FIG. 1, being 1 and 40 the left and right jambs, respectively, 23 and 27 the union pieces.

Figure 14:
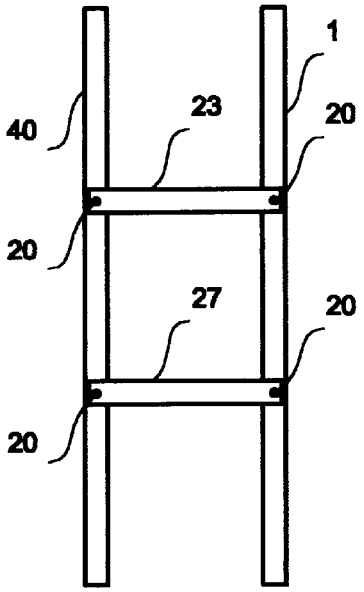
FIG. 14 is a view of back sides of a modular frame

FIG. 14 is a back view of that modular frame, who shows the same elements 40 and 1, union pieces 23, 27 and the screws or union elements 20.

Figure 15:
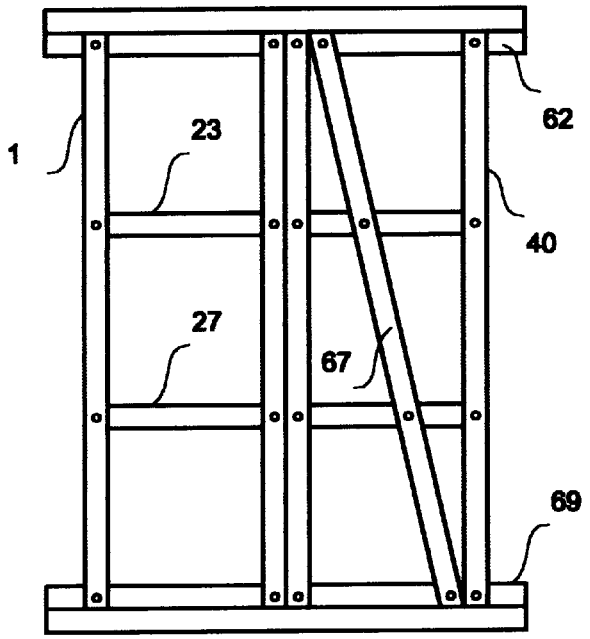
FIG. 15 is a front view of two modular frames.

FIG. 15 is a frontal view of modular frames similar as showed in FIG. 2, who shows jambs 1 and 40 of each one, the union elements 23 and 27, diagonal 67, the inferior union piece 69, the superior of union 62, having omitted that of union 66 and 68, who in the drawing are over 23 and 27.

Figure 16:
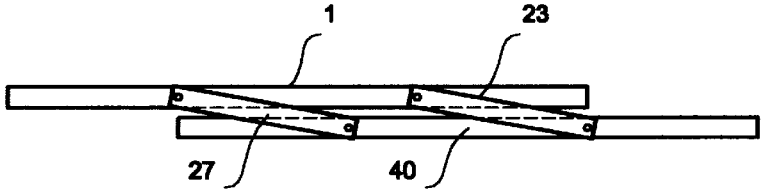
FIG. 16 shows a folded modular frame, with its two jambs attached.

FIG. 16 shows a modular frame as FIG. 13, folded for transport; can see jambs a and 40 joined and displaced, pieces 23 and 27 climbed respect the last.

Figure 17:
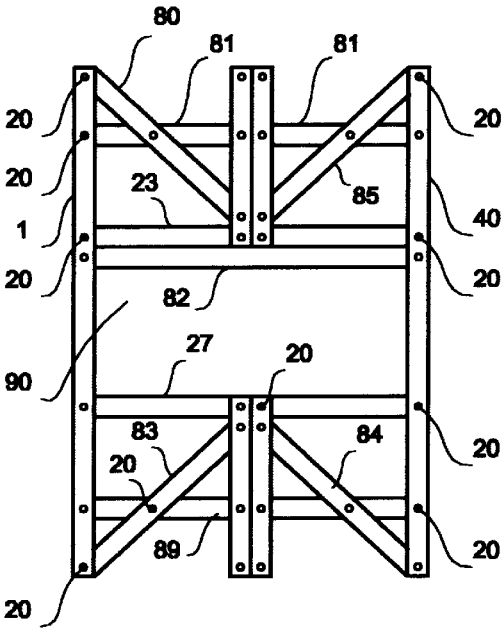
FIG. 17 shows two adjacent modular frames attached, with a space to put a window.

FIG. 17 shows two adjacent modular frames attached, with a space 90 for place a window; the jambs 1 and 40 of each one; union pieces 23,27 an additional piece 82; reinforcement diagonals 80, 83, 84, 85; the union pieces 81, 89 and union elements 20.

Figure 18:
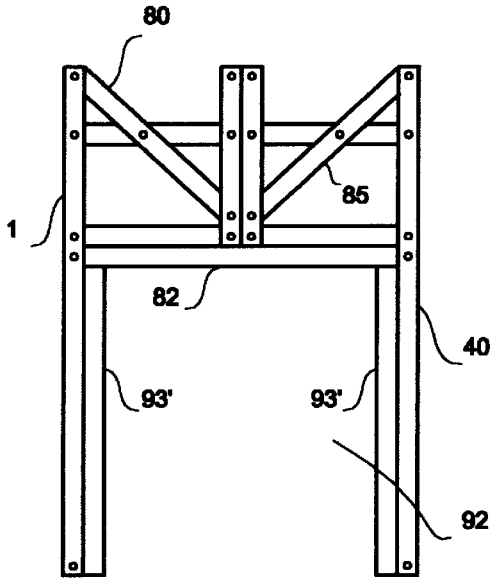
FIG. 18 shows two adjacent modular frames attached, with a space to put a door.

FIG. 18 shows two adjacent modular frames, jambs 1 and 40, with a space 92 for place a door, being 93" the door frame, 80, 85 the reinforcement diagonals and 82 the lintel.

Figure 19:
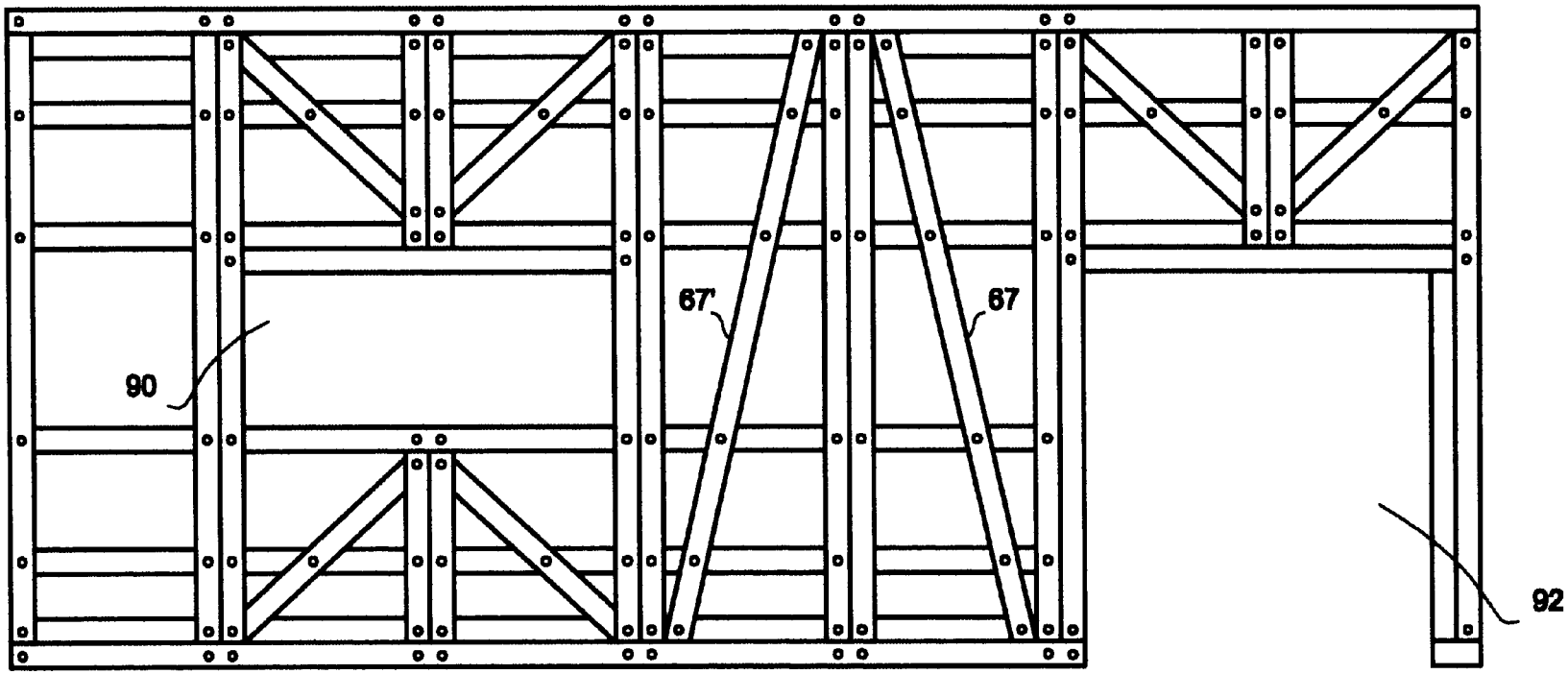
FIG. 19 is a view of a combination of several adjacent modular frames attached, who form a wall, with a door and a window.

FIG. 19 shows a possible combination to form a wall that by example has a window of a wide similar as two modules, and a door of a wide shorter than two modules.

In the same drawings, beginning from the left part, it is possible to see a first modular frame, after two, forming the space of a window 90, following two modular frames with diagonals 67 and 67", two modular frames prepared to put the frame 93 of the door in the space 92, with pieces showed in FIG. 17 and 18 respectively.

Figure 20:
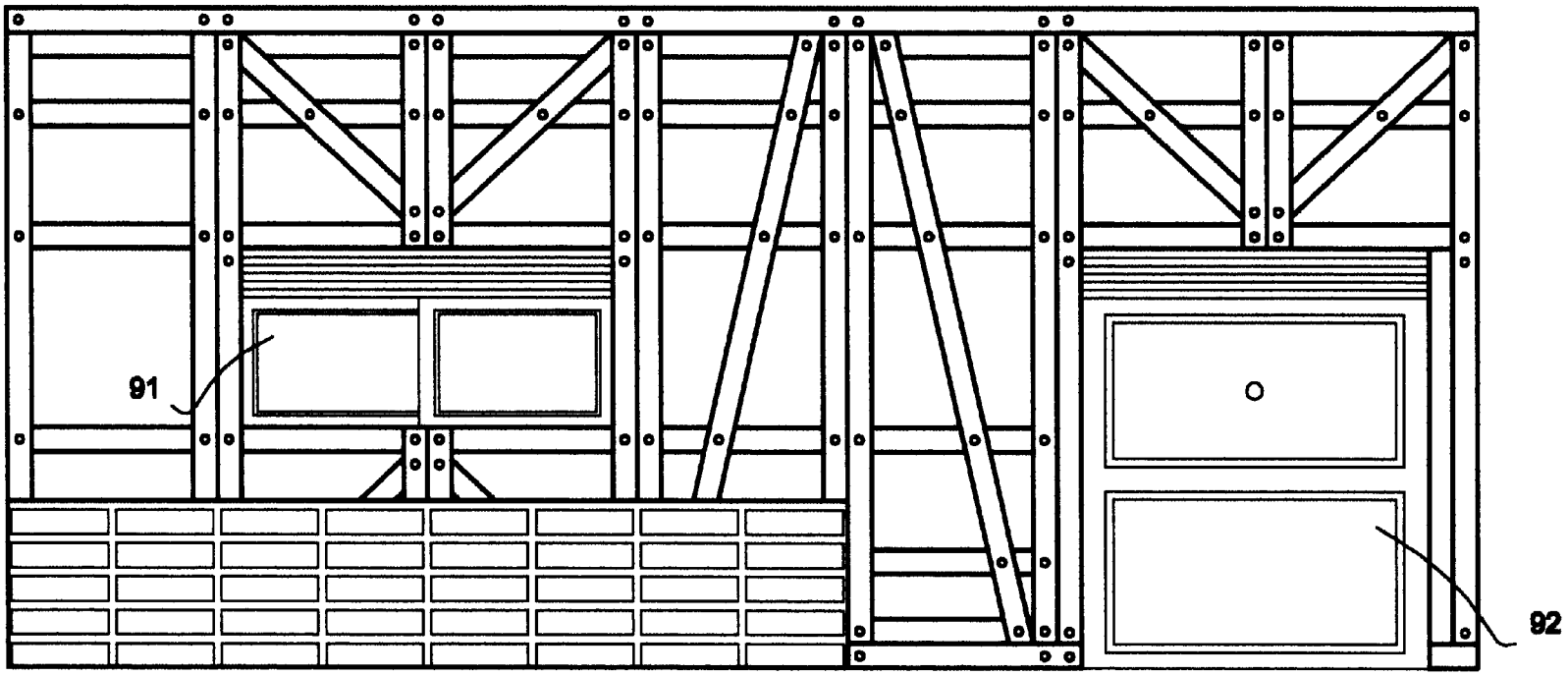
FIG. 20 is the same conjunct of FIG. 19 with part of blocks or plates placed in the bottom part, and the window and door collocated in its places.

FIG. 20 shows several modular frames, to form a wall, with a window 91 and a door 92 in its places. and blocks in inferior part, placed partially in modular frames.

Figure 21A:
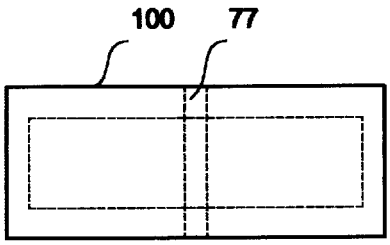
FIG. 21A to FIG. 21F show a prismatic section block, with a perimeter groove and the vertical filling channel, in plane, section and perspective views.
Figure 21B:
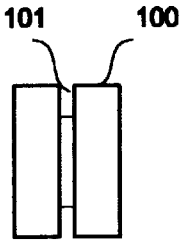

FIG. 21A to FIG. 21F are views and sections of a block 100 of prismatic section, with a perimeter groove 101, being FIG. 21A the frontal view with the vertical filling channel 77; FIG. 21B is a lateral view, FIG. 21C a cross section AA of plane of FIG. 21D.

Figure 21C:
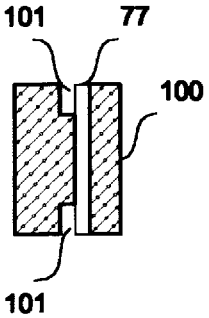
Figure 21D:
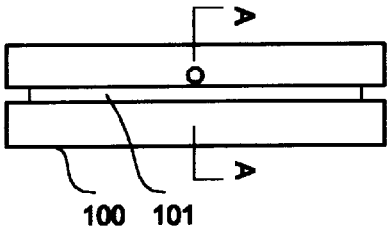
Figure 21E:
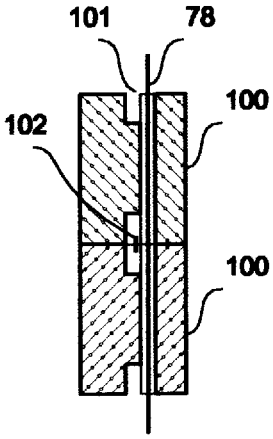
Figure 21F:
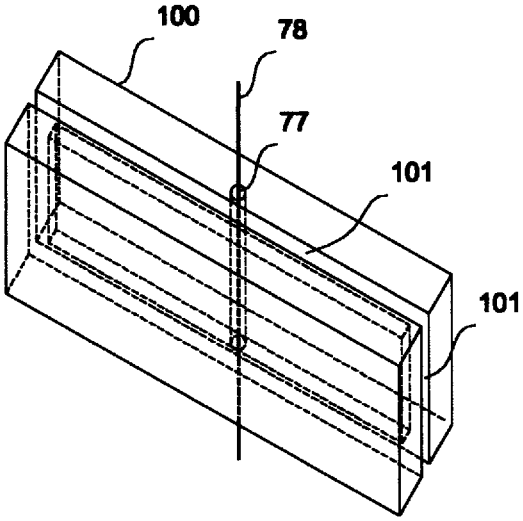

FIG. 21E is a section of two similar blocks as section FIG. 21C one over the other, where it is possible to see the filling channel 77, the vertical braze rod 78, the piece 102 who closes the horizontal joint between these blocks FIG. 21F is a perspective view of block 100 with a perimeter groove 101, the filling channel 77 and the braze rod 78.

Figure 22A:
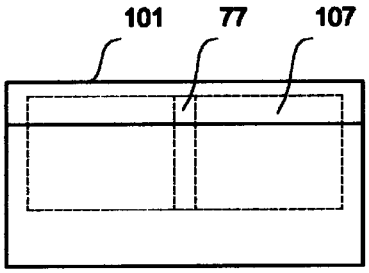
FIG. 22A to FIG. 22G show a block or plate with a vertical filling channel, in plane, section and perspective views.
Figure 22B:
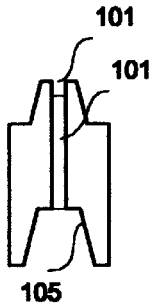
Figure 22C:
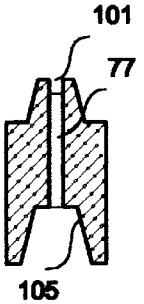
Figure 22D:
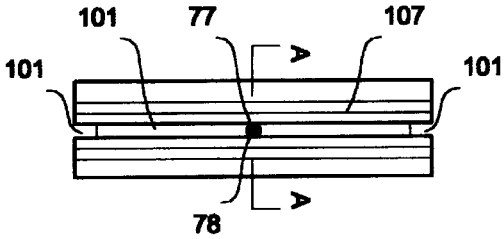
Figure 22E:
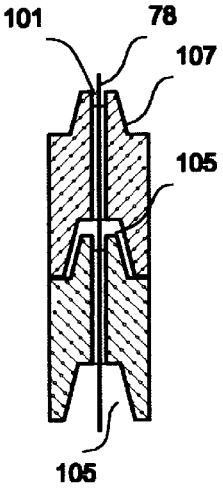
Figure 22F:
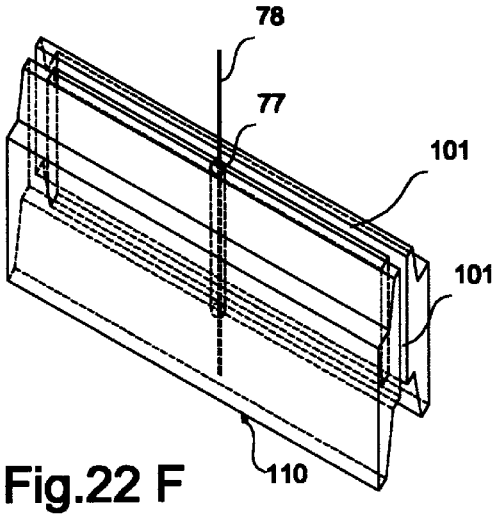
Figure 22G:
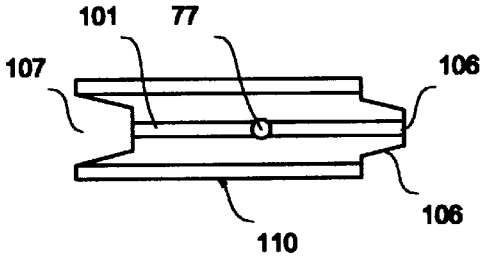

FIG. 22A to FIG. 22G show a block with two vertical grooved sides 101, a vertical filling channel as illustrated in plane view of FIG. 22D, or well with its two vertical sides type male and female of FIG. 22G, with a groove 101 in the superior part.

FIG. 22A is a frontal view where it is possible to see vertical channel 77 and superior out part 107.

FIG. 22B is a lateral view, where it is possible to see groove 101 and inferior cavity 105.

FIG. 22C is a section AA of plane view of FIG. 22D where can see channel 77 and groove 101.

FIG. 22D is a plane view where can see vertical filling channel 77, the braze rod 78 and groove 101.

FIG. 22E is a section of two similar blocks as of FIG. 22C, one over the other, showing a braze rod 78, the groove 101, cavity 105 located in the out part 107, which has a close space for filling material, to avoid this going out.

FIG. 22F is a perspective where shows the frontal side 110, the groove 101, the filling channel 77, the road 78.

FIG. 22G is a plane view of a similar block, with his four sides type male and female, with perimeter grooves, being 1 10 the frontal side, 106 the vertical out border, and 107 the entering part, 101 the perimeter groove, 77 the vertical filling channel.

FIG. 23 shows a prismatic section of a block with a perimeter groove 101, and an horizontal filling channel 77.

Figure 23A:
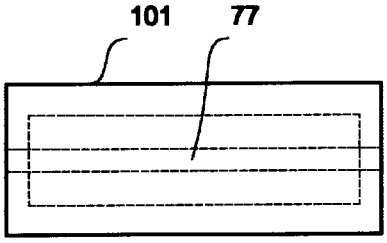
FIG. 23A to FIG. 23F correspond to a prismatic section block, with a perimeter groove and an horizontal filling channel, in plane, section an perspective views.

FIG. 23A is a lateral view, where can see groove 101, and the horizontal channel 77.

Figure 23B:
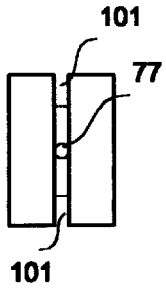

FIG. 23B is a lateral view, where it is possible to see groove 101, and filling channel 77.

Figure 23C:
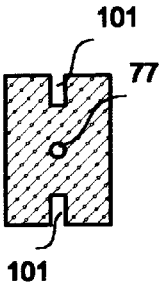
Figure 23D:
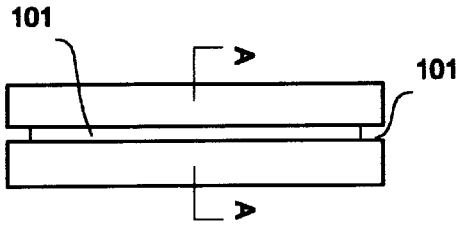

FIG. 23D is a plane view who shows groove 101.

FIG. 23C is a cut view by section AA, of FIG. 23D where it is possible to see perimeter groove 101, and filing channel 77.

Figure 23E:
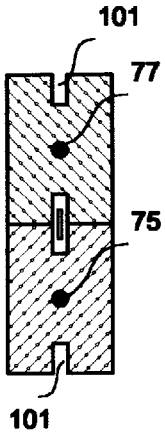

FIG. 23E is a cut view of two blocks one over the other,who who's groove 101, filling channel 77, the braze rod 75 and a piece between grooves 101, to close horizontal joint between the two blocks.

Figure 23F:
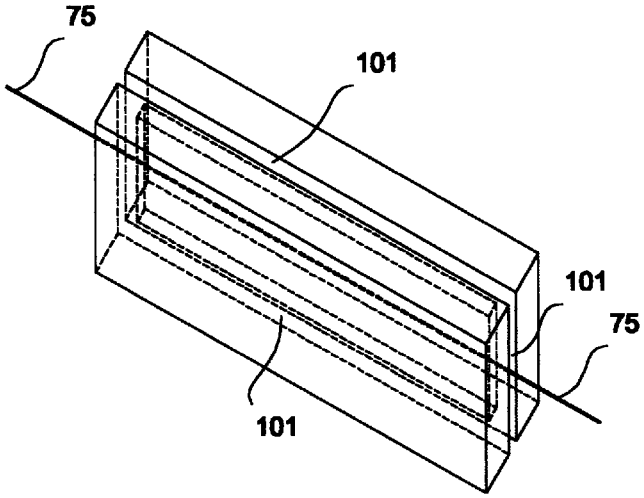

FIG. 23F is a perspective, where it is possible to see rod 75, the groove 101.

Figure 24:
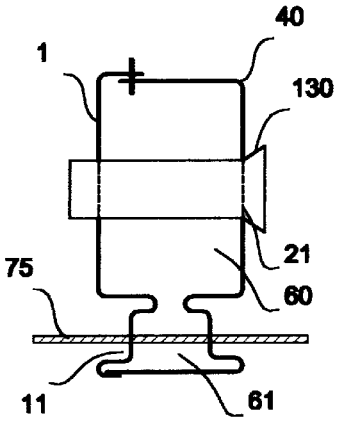
FIG. 24 correspond to a transversal section of two attached jambs, for blocks with horizontal channels.

FIG. 24 is a transversal section of two jambs jointed, similar as shown in FIG. 4, for blocks with horizontal filling channels, formed by jambs 1 and 40, joined, where it is possible to see the resistant filling channel 60, and for sealing 61.

75 is the horizontal braze rod, that passes by hole 11.

It is possible to see the hole 21 closed by bush box 130, with the space to pass pipes of installations, without filling material of channel 60 go out.

Figure 25:
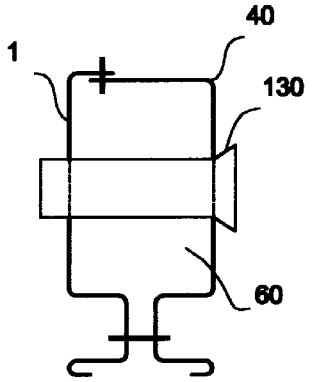
FIG. 25 correspond to a transversal section of two attached jambs, for blocks with vertical filling channels.

FIG. 25 is a transversal section of two adjacent jambs attached, similar as shown in FIG. 7, for blocks with vertical filling channel, formed by jambs 1 and 40.

It is possible to see resistant channel 60 and bush box 130.

FIG. 26 correspond to a block or plate with an horizontal filling channel.

Figure 26A:
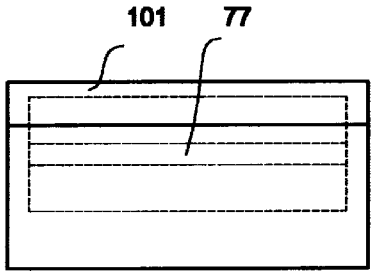
FIG. 26A to FIG. 26H correspond to a block with horizontal filling channels, who have two vertical borders with perimeter grooves, the other two with male and female shape, with a groove in the upper part or well the four borders in this last form, with a groove in the upper part and in the vertical borders, in plane, section and perspective views.

FIG. 26A is a frontal view, that shows groove 107 and filling channel 77.

Figure 26B:
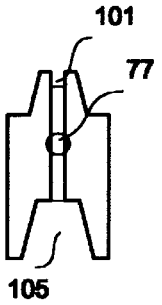

FIG. 26B is a lateral view,that shows groove 101, the filling horizontal channel 77 and the inferior opening 105.

Figure 26C:
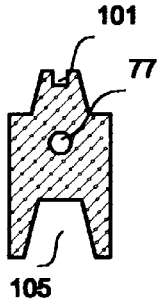

FIG. 26C is a cut view of section AA of FIG. 24D where it is possible to see groove 101, horizontal filling channel 77 and opening 105.

Figure 26D:
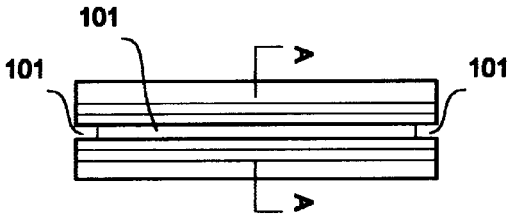

FIG. 26D is a plane that view shows see groove 101.

Figure 26E:
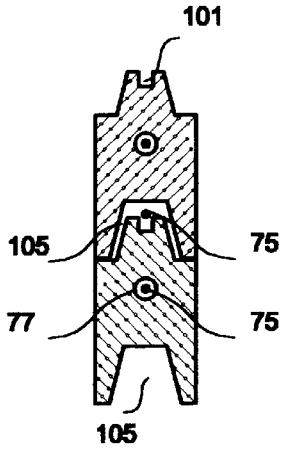

FIG. 26E is a cut view showing two blocks one over the other, with groove 101, the filling channel 77, the braze rod 75, and opening 105.

Figure 26G:
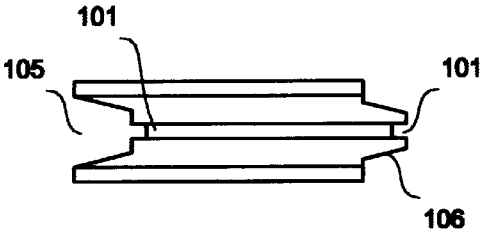

FIG. 26G is a plane view that shows a similar block with its vertical sides in form of male and female 105, 106, being 101 the perimeter groove.

Figure 26F:
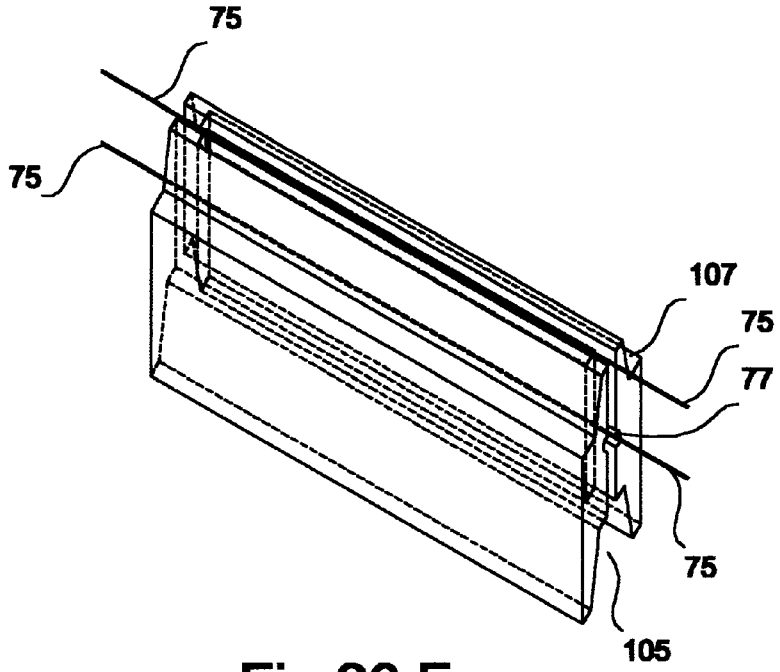

FIG. 26F is a perspective that shows rod 75, located in the superior groove and in the filling channel 77, the out part 107 and opening 105.

Figure 26H:
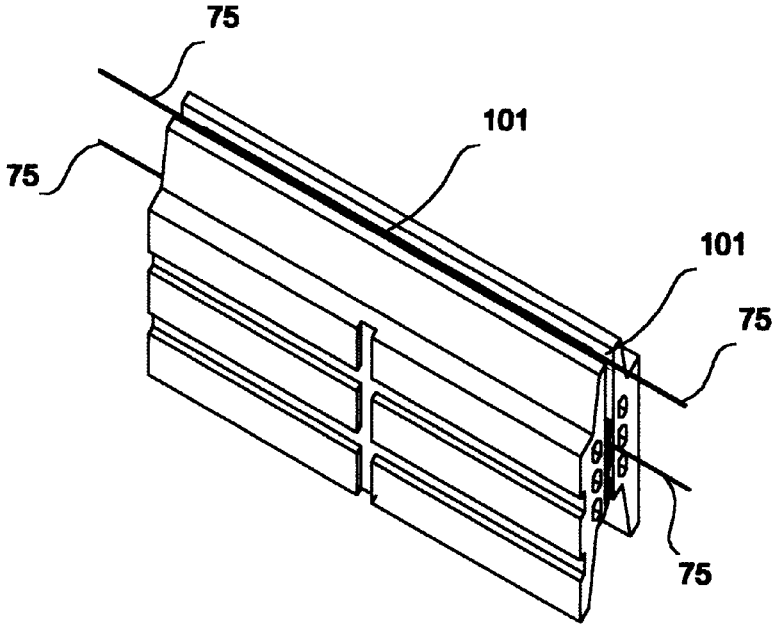

FIG. 26H is a similar perspective view, for a piece with holes, with the superior groove 101, rods 75, and the front part, with in and out parts forming a drawing.

FIG. 27A to FIG. 27F are details of piece 79 and 79' with the shape of an L and an inverted U, for the case of blocks or plates with vertical filling channel and vertical braze rods, putted between two blocks in its horizontal joints, with a hole to pass the braze rod 78 and the filling material, and a folded side takes contact with union pipes 66 and 68, for the purpose to limit bulge high, of the vertical nerve.

Opposite side of vertical part 79', has the shape of the superior part of block, entering in the perimeter groove, or over the out part.

Figure 27A:
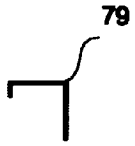
FIG. 27A to FIG. 27C are details of a piece, that when placed between blocks, limit bulge high, of vertical filling nerves.

FIG. 27A is a lateral view.

Figure 27B:
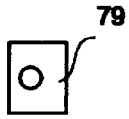

FIG. 27B is a plane view where it is possible to see the hole to pass the vertical braze rod.

Figure 27C:
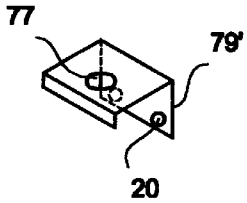

FIG. 27C is a perspective view, where it is possible to see the vertical part 79' takes contact with union pieces 66 or 68 of FIG. 2.

Figure 27D:
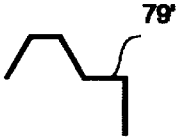
FIGS. 27D, 27E and 27F are, respectively, a side view, a plan view and a perspective view of a vertical part used for the bricks or plates.

FIG. 27D is a lateral view for the case in which the superior side of blocks or plates are type male or female.

Figure 27E:
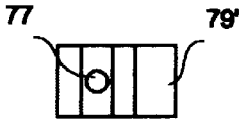
Figure 27F:
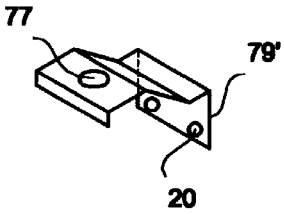

FIG. 27E is a plane view of FIG. 27D, and FIG. 27F is a perspective view of this variance, with hole 77, part 79' who takes contact with 66 or 68 and 20 the union elements with these last.

Figure 28:
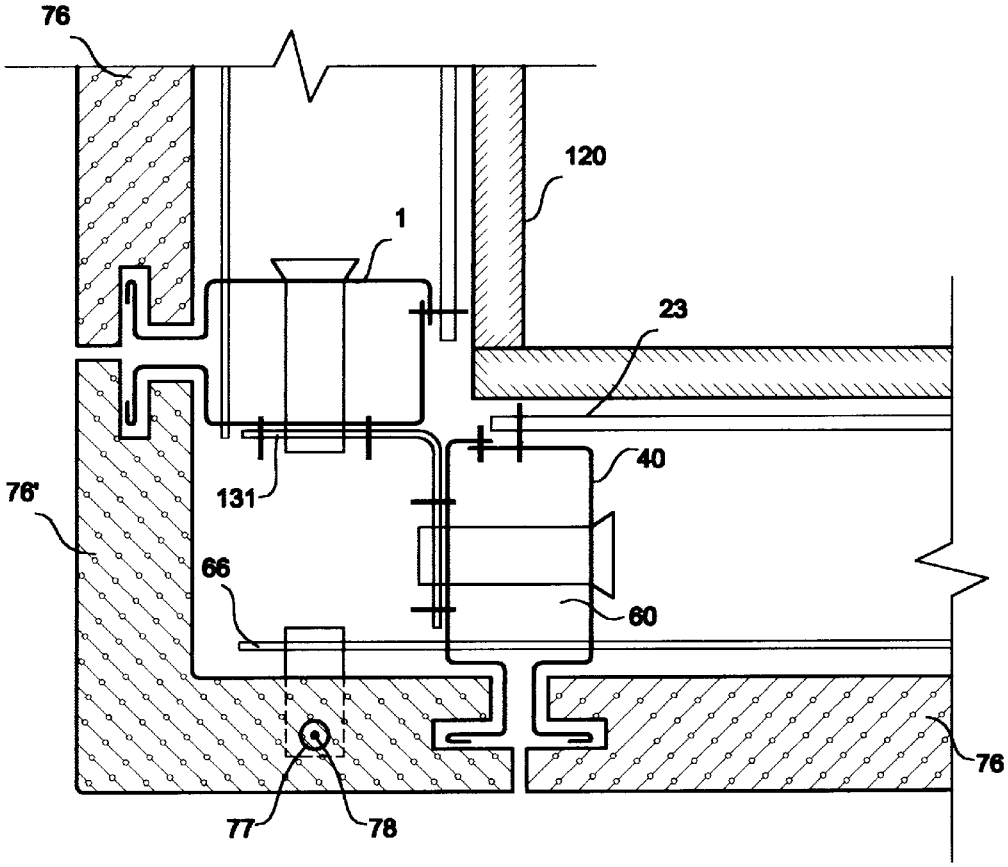
FIG. 28 is a transversal section of an exterior wall and other located perpendicular.

FIG. 28 is a section of the angle of two external perpendicular walls, being 76 the blocks, 76' the corner block, 1 and 40 the jambs, 60 the resistant channels, 120 the interior covering, by example the plaster table, 131 the square for union of two perpendicular frames, 23 the union pieces, 66 for union of several frames, 77 the vertical filling channel, 78 the vertical braze rod.

FIG. 29 is a section view by plane AA of FIG. 7, for blocks of plates of perimeter section with the filling channel and rod for vertical braze.

It is possible to see inferior piece 69 to joint modular frames, with a vertical side who functions besides as a mold to fill and get a concrete beam; the horizontal piece 70 with holes to link with foundation beam 116, through bolt 117; 72 the vertical side of union piece 79, opposite to 69.

It is possible to see blocks or plates 76; filling channel 77; braze rod 78; a piece 62 for superior union and a symmetric 90, who is putted when block riches the superior part and braze rod 78 have passed for filling channels.

It is possible to see jamb 1; union pieces 23 and 27; and for union between several modular frames 66,68.

Also holes to pass pipes 21, 24, 28, 29, the pieces 29; covering of interior side 120.

Figure 30:
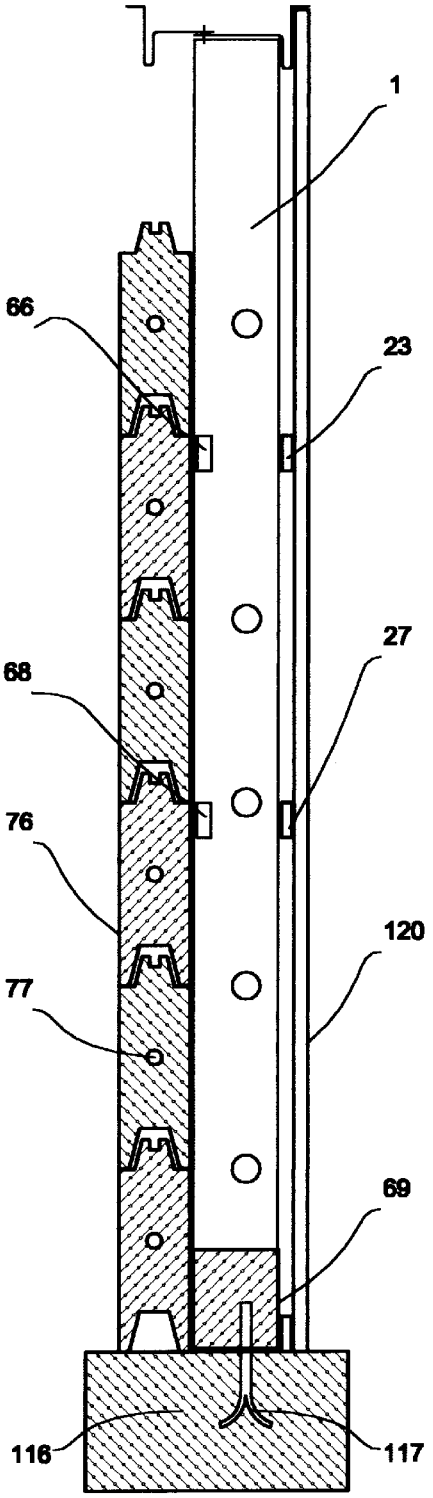
FIG. 30 is a similar section, of a wall with horizontal filling channels.

FIG. 30 is a similar section view by plane AA of FIG. 5, where it is possible to see the same elements, jamb 1; the union pieces 23 and 27; the pieces for joint several frames 66 and 68; blocks 76 and the horizontal filling channels 77; the inferior union piece 69; the foundation beam 116; the anchor bolt 117; and a side covered by example with plaster table 120.

Figure 31:
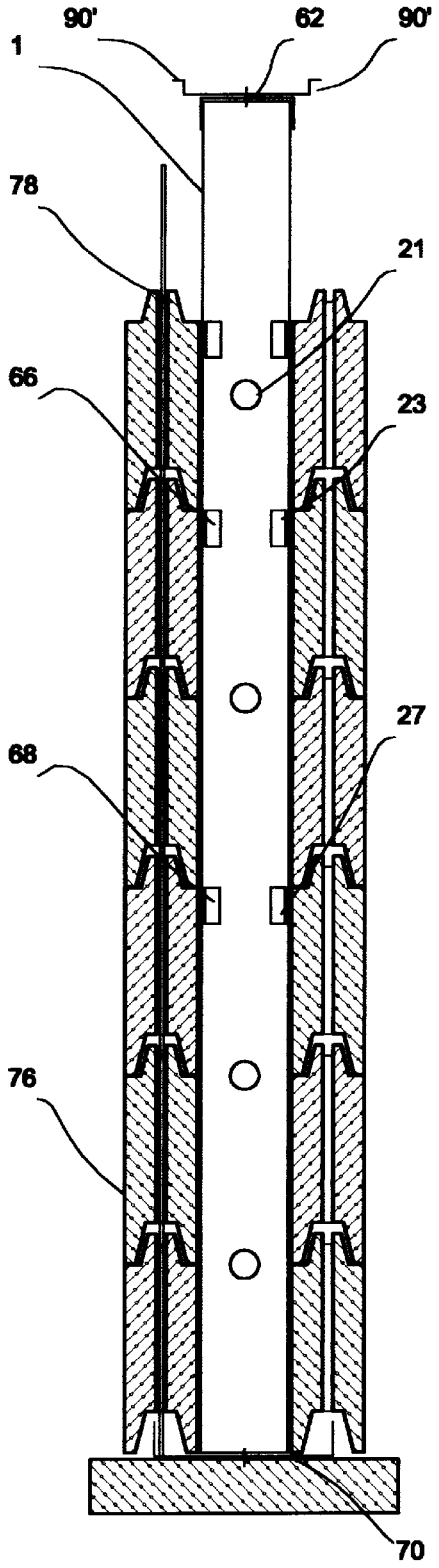
FIG. 31 is a similar section of a wall with the two sides covered with blocks, of vertical filling channel type.

FIG. 31 is a similar section view by plane AA of FIG. 12B for the case of blocks or panel are placed in both sides of the wall.

It is possible to see blocks 76; the holes for pass pipes 21 the jambs 1; the piece for superior union 62, with two complementary pieces 90'; the union pieces 23, 27; the transversal pieces 66,68; the pieces for inferior linking 70 the vertical braze rods 78.

It will be understood various modifications can be made to the invention without departing from the spirit and scope of it. Therefore the limits of the invention should be determined from the appended claims.

What is claimed is:

1. A system for building a wall comprising:

at least one frame formed by two substantially vertical profiled jambs and at least one cross linkage member connecting one jamb to the other, the profile of each jamb including a fin shaped inwardly of the frame and substantially extending the length of said jamb;

a plurality of blocks or plates provided with grooves at the borders thereof, said grooves shaped to match a profiled jamb such that a fin of one such jamb may fit in the border grooves of blocks or plates stacked adjacent said jamb;

at least one hole traversing each block or plate, said holes adapted to form vertical or horizontal ducts through adjacent ones of said blocks or plates when stacked and/or placed end to end within said frame; and rod means adapted for insertion through said ducts and reinforcing said adjacent blocks or plates.

2. The wall building system of claim 1, comprising a plurality of modular frames and wherein said jambs are profiled whereby, upon placing two frame modules next to each another to form a wall section of the building, the adjacent jambs thereof form a vertical channel for pouring in settable material for reinforcing said wall section.

3. The wall building system of claim 2, wherein said material includes concrete.

4. The wall building system of claim 1, wherein said frame comprises at least two vertically-spaced linkage members having corresponding ends articulated to said jambs such that said frame is foldable in a manner in which said jambs may be placed generally alongside one another.

5. The wall building system of claim 4, wherein at least some of said grooves are formed horizontally lengthwise on the top or bottom of said blocks or plates such that two grooves of adjacent blocks or plates pair up to form a hole forming a horizontal one of said ducts.

6. The wall building system of claim 5, wherein said jambs are profiled such that upon placing two frames next to each another to form a wall section of the building, the adjacent jambs thereof form a vertical channel for pouring in sealing material material for penetrating said horizontal ducts and sealing said blocks or plates.

7. The wall building system of claim 4, wherein at least some of said grooves are formed vertically at the ends of said blocks or plates such that two grooves of adjacent blocks or plates pair up to form a hole forming a vertical one of said ducts.

8. The wall building system of claim 4, wherein said holes are adapted for said ducts to receive a settable reinforcing material in addition to said rods.

9. The wall building system of claim 4, wherein said rods include vertically and horizontally placed rods.

10. The wall building system of claim 4, said frame further including a bottom U-shaped member connecting the bottom ends of the jambs thereof and serving as a mould for settable material.

11. The wall building system of claim 4, said frame further including a top V-shaped member connecting the top ends of the jambs thereof and adapted to enable placement of said blocks or plates.

12. A foldable frame for use in building a wall section and comprising:

two substantially parallel profiled jambs, the profile of each jamb having a front portion and a back portion, said front portion including a fin shaped inwardly of the frame and substantially extending the length of said jamb;

at least two spaced-apart cross-linkage members connecting one jamb to the other at the back portions thereof; and holes formed at least in said front portions of said jambs adapted for passing rod means and sealing material to reinforce and seal blocks or plates placed in said frame for building said wall section;

wherein said cross-linkage members have ends joined to each jamb by means of respective articulations such that said frame may be folded for storage or transport in a manner in which said jambs may be placed generally alongside one another and unfolded for use in building said wall section in a manner whereby said cross-linkage members are substantially perpendicular to said jambs.

* * * * *